US007326504B2

(12) United States Patent
Graham et al.

(10) Patent No.: US 7,326,504 B2
(45) Date of Patent: Feb. 5, 2008

(54) IMAGED ANTI-COPY FILM

(75) Inventors: Paul D. Graham, Woodbury, MN (US); Jonathan P. Kitchin, Leander, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 11/251,166

(22) Filed: Oct. 14, 2005

(65) Prior Publication Data

US 2007/0087294 A1 Apr. 19, 2007

(51) Int. Cl.
*G03C 1/765* (2006.01)
*G03G 5/10* (2006.01)
*B42D 15/00* (2006.01)

(52) U.S. Cl. ..... 430/10; 430/15; 430/22; 430/104; 430/200; 430/201; 283/94; 283/902; 428/32.19; 428/32.39; 428/915

(58) Field of Classification Search ..... 430/10, 430/15, 22, 200, 201, 104; 428/32.19, 32.39, 428/915; 283/94, 902
See application file for complete search history.

(56) References Cited

U.S. PATENT DOCUMENTS 3,524,789 A 8/1970 Olsen
3,689,346 A 9/1972 Rowland
3,691,140 A 9/1972 Silver
3,707,416 A 12/1972 Stevens
3,857,731 A 12/1974 Merrill, Jr. et al.
4,097,634 A 6/1978 Bergh
4,166,152 A 8/1979 Baker et al.
4,244,683 A 1/1981 Rowland
4,495,318 A 1/1985 Howard
4,536,362 A 8/1985 Donaldson
4,576,850 A 3/1986 Martens
4,578,298 A 3/1986 Nagafuchi
4,601,861 A 7/1986 Pricone et al.
4,684,593 A * 8/1987 Wicker ..... 430/6
4,894,060 A 1/1990 Nestegard
4,984,060 A 1/1991 Ohmi et al.
5,045,569 A 9/1991 Delgado
5,073,457 A 12/1991 Blackwell
5,134,198 A 7/1992 Stofko, Jr. et al.
5,145,544 A 9/1992 Leseman et al.
5,175,030 A 12/1992 Lu et al.
5,183,597 A 2/1993 Lu
5,254,388 A 10/1993 Melby et al.

(Continued)

FOREIGN PATENT DOCUMENTS

JP 10-35087 2/1998

(Continued)

OTHER PUBLICATIONS

U.S. Appl. No. 11/250,676, filed Oct. 14, 2005.

*Primary Examiner*—Richard L. Schilling

(57) ABSTRACT

An anti-copy film is disclosed. The film has a light transmissive imageable substrate having opposing first and second surfaces. Each surface has an image receptive coating. Complementary positive and negative images are disposed on the first and second surfaces such that an imaged area on the first surface is in registration with a non-imaged area on the second surface. The anti-copy film appears substantially opaque when viewed orthogonally to and appears partially transparent when viewed obliquely to either the first or second surfaces.

11 Claims, 1 Drawing Sheet

U.S. PATENT DOCUMENTS

| | | | | |
|---|---|---|---|---|
| 5,290,068 | A | | 3/1994 | Gundjian |
| 5,301,981 | A | | 4/1994 | Nesis |
| 5,389,723 | A | | 2/1995 | Iqbal et al. |
| 5,431,644 | A | | 7/1995 | Sipinen et al. |
| 5,571,617 | A | | 11/1996 | Cooprider et al. |
| 5,663,241 | A | | 9/1997 | Takamatsu et al. |
| 5,714,237 | A | | 2/1998 | Cooprider et al. |
| 5,728,449 | A | * | 3/1998 | Steininger et al. ..... 428/195.1 |
| 5,756,625 | A | | 5/1998 | Crandall et al. |
| 5,795,643 | A | * | 8/1998 | Steininger et al. ..... 428/143 |
| 5,824,748 | A | | 10/1998 | Kesti et al. |
| 5,858,139 | A | | 1/1999 | Ouderkirk et al. |
| 5,993,940 | A | | 11/1999 | Ouderkirk et al. |
| 6,033,516 | A | * | 3/2000 | Steininger et al. ..... 156/277 |
| 6,189,934 | B1 | | 2/2001 | Scruggs |
| 6,297,906 | B1 | | 10/2001 | Allen et al. |
| RE37,563 | E | | 2/2002 | Cooprider et al. |
| 6,367,128 | B1 | | 4/2002 | Galkiewicz et al. |
| 6,398,370 | B1 | | 6/2002 | Chiu et al. |
| 6,502,935 | B1 | | 1/2003 | Barcock et al. |
| 6,514,589 | B1 | | 2/2003 | Chang et al. |
| 6,806,310 | B2 | | 10/2004 | Kopolow et al. |
| 6,830,798 | B2 | | 12/2004 | Bowles et al. |
| 2003/0038924 | A1 | | 2/2003 | Vellgdan et al. |
| 2004/0130788 | A1 | | 7/2004 | Minami |
| 2004/0202822 | A1 | | 10/2004 | Bourdelais et al. |
| 2005/0027068 | A1 | | 2/2005 | Kopolow et al. |
| 2006/0012059 | A1 | | 1/2006 | Cheng et al. |

FOREIGN PATENT DOCUMENTS

| | | |
|---|---|---|
| JP | 2001-219681 | 8/2001 |
| JP | 2003-127494 | 5/2003 |
| KR | 2003-71565 | 9/2003 |
| KR | 2005-21016 | 3/2005 |
| WO | WO 99/17630 | 4/1999 |

* cited by examiner

IMAGED ANTI-COPY FILM

CROSS REFERENCE TO RELATED APPLICATION

The present invention is related to U.S. patent application Ser. No. 11/250,676 filed on even date herewith.

FIELD OF INVENTION

The present invention relates to an imaged anti-copy film. In particular, the present invention relates to a polymeric based anti-copy film having a imageable substrate that is imageable on opposing surfaces, where the images are complementary to one another, the film being well suited for use with documents.

BACKGROUND

Several approaches for making anti-copy articles are known in the art. For example, one approach involves decreasing the contrast between the indicia present on the sheet of paper and the paper background so that the indicia will be practically invisible to a copying machine. Decreasing the contrast can be accomplished by applying a set of color forming dyes to the sheet of paper that closely matches the color of the indicia or by covering the document with a transparent film of selected colors, such as red, orange, or brown. Another approach involves the use of micro-optical elements that redirect the exposure light generated from a copying machine such that the light does not contact the document. This process can be accomplished by using a set of micro-optical elements that focus the exposure light on to light absorbing elements.

There may be some drawbacks to the above described approaches. For example, decreasing contrast between the indicia and the paper background can interfere with the readability of the document. Also, as copying machines have advanced, even small differences in color intensity may be detected. The use of micro-optical elements may be useful in an anti-copy article, but such elements can be expensive to manufacture.

There is a need for different anti-copy film constructions that can be easily manufactured without the need to minimize the contrast between the paper and the indicia.

SUMMARY

The present invention provides polymeric based anti-copy films that can be easily manufactured without the need for altering the indicia contrast with respect to the paper. The film can be provided in label form, in tape form, or in document laminate form for easy dispensing and attaching to a document. In another application, a pocket can be constructed with the anti-copy film forming the front, a polymeric backing or another piece of anti-copy film forming the back, and the film and backing or two films are attached on three sides, leaving the fourth, typically top side, open for insertion and removal of a document. Other configurations can be used.

In one aspect, the present invention pertains to an anti-copy film comprising: (1) a light transmissive, imageable substrate having opposing first and second surfaces; (2) complementary positive and negative images disposed on the first and second surfaces, such that an imaged area on the first surface is in registration with a non-imaged area on the second surface, wherein when the anti-copy film appears substantially opaque when viewed orthogonally to and appears partially transparent when viewed obliquely to either the first or second surfaces. In one embodiment, the imageable substrate further includes an image receptive coating, such as, e.g., an inkjet receptive coating.

As used herein, the term "light transmissive" means generally the ability of a material to transmit incident visible light. While the material may diffract and absorb some incident light, a large portion of the light will be transmitted. The term "complementary positive and negative images" means generally that the positive image disposed on one side of the imageable substrate will have its negative image disposed on the opposite side.

In this document, the term "about" is presumed to modify all numerical values.

BRIEF DESCRIPTION OF THE DRAWINGS

The invention can be better described with reference to the following drawings, wherein.

These figures are idealized, are not drawn to scale, and are intended for illustrative purposes.

DETAILED DESCRIPTION

Figure 1:
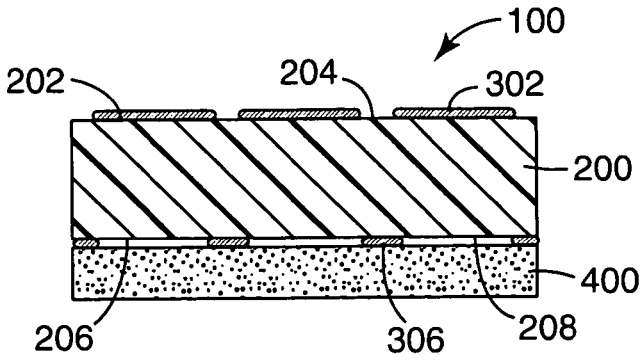
FIG. 1 is a cross sectional view of one exemplary embodiment of the present invention.

FIG. 1 shows a cross sectional view of one exemplary embodiment of anti-copy film 100 of the present invention. The anti-copy film includes light transmissive, imageable substrate 200 having opposing first surface 202 and second surface 206 upon which complementary positive and negative images are disposed. In one embodiment, the imageable substrate includes image receptive coatings disposed on at least one of the first and second surfaces. The first surface includes first imaged region 302 that is in registration with second non-imaged region 208. Similarly, the first surface includes first non-imaged region 204 that is in registration with second imaged region 306. The phrase "in registration" means generally that the imaged region on one surface is disposed in substantially the same area as the non-imaged region on the opposite surface.

Figure 2A:
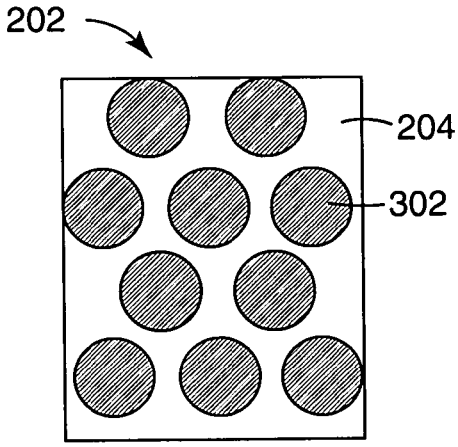
FIGS. 2*a* and 2*b* are front and back views, respectively, of the embodiment of FIG. 1.
Figure 2B:
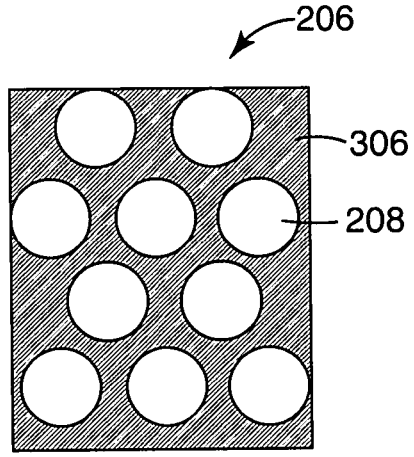

FIGS. 2*a* and 2*b* are top and bottom views, respectively, of the embodiment of FIG. 1. In FIG. 2*a*, first surface 202 of the imageable substrate includes first imaged region 302 in the form of circles and first non-imaged region 204. Other shapes and configurations can be used. In FIG. 2*b*, second surface 206 of the imageable substrate includes second imaged region 306 and second non-imaged region 208, also in the form of circles that are complementary to or the negative image of the first imaged region.

Figure 3:
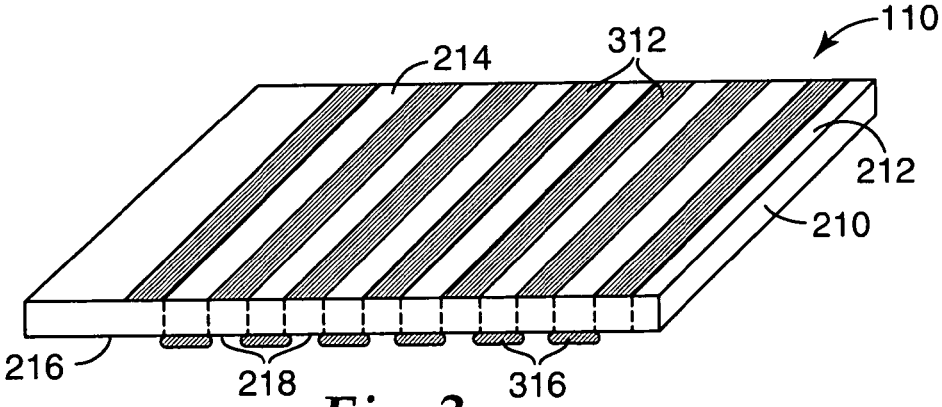
FIG. 3 is a perspective view of another exemplary embodiment of the present invention.

FIG. 3 is a perspective view of another exemplary embodiment anti-copy film 110 of the present invention. The anti-copy film includes light transmissive, imageable substrate 210 having opposing first surface 212 and second surface 216 upon which complementary positive and negative images are disposed. In this particular embodiment, the complementary positive and negative images are in form of first imaged striations 312 and first non-imaged stripes 214 on the first surface. Second imaged striations 316 and second non-imaged stripes 218 are disposed on the second surface.

In one embodiment, the first imaged striations are in registration with the second non-imaged stripes and the first non-imaged stripes are in registration with the second imaged striations.

Figure 4:
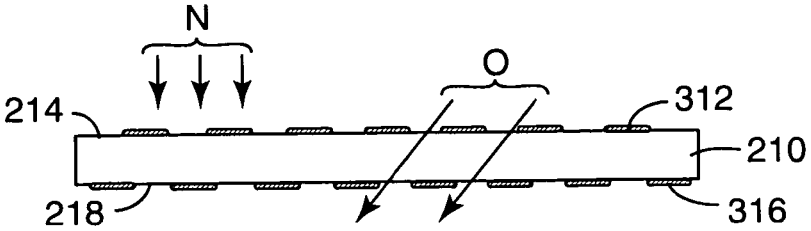
FIG. 4 is a cross sectional view of the embodiment of FIG. 3.

FIG. 4 is an cross sectional view of the embodiment in FIG. 3 showing that when a user views the anti-copy film at a substantially normal orientation (denoted schematically by arrows N) to the first or the second surface, the film will appear opaque. Any indicia on a document that would lie underneath the film, i.e., the document would be disposed proximate to second surface 316, will most likely not be readable. Thus, when the film is attached to a document and one tries to make a copy of the document using a photocopy machine, the result would be a substantially dark copy with little to no discernable indicia. However, when the user views the anti-copy film at an oblique angle (denoted schematically by arrows O) to the first or the second surface, the film will appear partially transparent allowing the user to read the indicia. Photocopying machines that are commercially available today are incapable of orienting the film and the attached document at an oblique angle.

In one embodiment, the width of the imaged striations is less than 375 micrometers and the width of the non-imaged stripe is less than 375 micrometers. The width of the imaged striation may but does not have to be equal to the width of the non-imaged stripes. For example, the width of the imaged striation could be less than the width of the non-imaged stripes, such as, e.g., the width of the imaged striations being about 75% to 95% of the width of the non-imaged stripes. In another example, the width of the imaged striation could be greater than the width of the non-imaged stripes, such as, e.g., the width of the imaged striation being about 105% to 125% of the width of the non-imaged stripes. The advantage of having unequal widths for the striations and the non-imaged stripes is that they do not have to be in registration with one another.

In another embodiment, the width of the imaged striation on the first imageable substrate is substantially equal to the width of the non-imaged striation on the second surface and vice versa. At a width of 250 micrometers for the imaged striations, the resulting privacy film has its maximum transparency at an oblique angle of 45° from the normal, in the case where the thickness of the light transmissive, imageable substrate is also on the order of 250 micrometers.

As stated above, in some embodiments, the light transmissive, imageable substrate further includes an image receptive coating. Such a coating can be of any composition that adheres to the imageable substrate and is suitable for digital printing, such as inkjet printing, color inkjet printing, laser printing, and dye or mass transfer printing. The image receptive coating can be receptive to electrographic toner. When the image receptive coating is an inkjet receptive coating, suitable coatings would include two general classes of compositions: (1) those that absorb ink by capillary action, commonly described as porous, microporous, or nanoporous coatings, which may include silica, mixed oxides, and hydroxides of aluminum, and (2) those that include a hydrophilic polymer that absorbs ink by swelling, which are commonly referred to as swellable polymer coatings.

Suitable porous, microporous, or nanoporous coatings include U.S. Pat. No. 6,502,935 (Barcock et al.) and U.S. Pat. No. 6,830,798 (Misuda et al.).

Suitable swellable polymer, ink receptive coatings are described in U.S. Pat. No. 5,134,198 (Stofko, Jr. et al.), and U.S. Pat. No. 5,389,723 (Iqbal et al.). In very brief summary, both patents describe semi-interpenetrating polymer networks. These networks are blends of polymers where at least one of the polymeric components is crosslinked after blending to form a continuous network throughout the bulk material, and through which the uncrosslinked polymeric components are intertwined in such a way as to form a macroscopically homogeneous composition. Another suitable image receptive coating is described in U.S. Pat. No. 6,806,310 (Kopolow et al.), which discloses copolymers of dimethylaminopropyl methacrylamide (DMAPMA) and hydroxyethyl methacrylate (HEMA). It is stated that imageable substrates coated with these copolymers are capable of absorbing the solvents, e.g., water or organic solvents, of digital printing inks rapidly with dry times of less than one minute. Yet another suitable image receptive coating is described in U.S. Patent Application Publication No. U.S. 2005/0027068, which discloses terpolymer compositions of vinyl caprolactam, DMAPMA, and HEMA to coat imageable substrates for use in computer printers.

As stated, in one embodiment, a light transmissive adhesive is disposed on the second surface of the imageable substrate. The adhesive can be a permanent adhesive or a repositionable adhesive. Various repositionable adhesives can be used. Suitable repositionable adhesives are disclosed in U.S. Pat. Nos. 3,691,140 (Silver); 3,857,731 (Merrill et al.); 4,166,152 (Baker et al.); 4,495,318 (Howard); 5,045,569 (Delgado); 5,073,457 (Blackwell) and 5,571,617 (Cooprider et al.), 5,663,241 (Takamatsu et al.); 5,714,237 (Cooprider et al.); US Re. 37,563 (Cooprider et al.); and U.S. Pat. Nos. 5,756,625 (Crandall et al.) and 5,824,748 (Kesti et al.). The adhesive, whether permanent or repositionable, can be solvent based, water based, or can be a solventless, hot melt adhesive. In one embodiment, the refractive index of the adhesive is substantially similar to the refractive index of the imageable substrate. By substantially similar, it is meant that the adhesive does not appreciably interfere with the light diffraction and refraction.

EXAMPLES

Two pieces of 125 micrometers thick, two-side coated, DuraKote™ film (commercially available from Tekra Corporation, New Berlin, Wis.) were laminated to each other using 50 micrometers thick Scotch® Adhesive Transfer Tape 467 MP (commercially available from 3M Company, St. Paul, Minn.). The resulting multilayer construction had a total thickness of 300 micrometers. Both surfaces of the multilayer construction were imaged using a Xiekon™ 320D digital electrophotographic printer, which is a dry toner based, digital electrophotographic printer (commercially available from Punch Graphix Co., Belgium). The images were black striations of 288 micrometers in width with a gap or non-imaged region of 212 micrometers. The relative positions of the striations were adjusted until the striation on one surface registered with the gap on the other surface to yield an anti-copy film.

The anti-copy film was placed over a paper document bearing standard 12 point text. It was noted that the film appeared dark when it was viewed along the normal to the film plane. Under such an orientation, it was very difficult to discern any text underneath the film. The film, however, appeared much more transparent and it was possible to read the underlying text when it was viewed at oblique angles that are nearly perpendicular to the printed striations.

A piece of Scotch® Adhesive Transfer Tape 950, commercially available from 3M Company, was used to attach the anti-copy film to a printed side of the entire document. The composite was photocopied in a Lanier® 5455 photocopy machine. The photocopy thus produced had dark sections and the text was completely obscured.

What is claimed is:

1. An anti-copy film comprising:

a light transmissive imageable substrate having an image receptive coating disposed on opposing first and second surfaces, wherein the image receptive coating is an inkjet receptive coating selected from the group consisting of (i) porous coating comprising oxides or silicates and (ii) swellable hydrophilic polymer coating;

complementary positive and negative images disposed on the first and second surfaces, such that an imaged area on the first surface is in registration with a non-imaged area on the second surface, wherein the anti-copy film appears substantially opaque when viewed orthogonally to and appears partially transparent when viewed obliquely to either the first or second surfaces.

2. The anti-copy film of claim 1, wherein the complementary positive and negative images include a plurality of imaged striations disposed between a plurality of non-imaged stripes.

3. The anti-copy film of claim 2, wherein the width of the imaged striation is less than about 375 micrometers and the width of the non-printed stripe is less than about 375 micrometers.

4. The anti-copy film of claim 2, wherein the imaged striations and the non-imaged stripes of the first surface are in registration with the non-imaged stripes and imaged striations, respectively, of the second surface.

5. The anti-copy film of claim 2, wherein the imaged striations and the non-images stripes are substantially the same width of about 250 micrometers.

6. The anti-copy film of claim 2, wherein the width of the imaged striation is substantially the same as the thickness of the imageable substrate.

7. The anti-copy film of claim 1, wherein the film appears substantially opaque when viewed orthogonal to the first or second surface and appears transparent when viewed at a 45° angle to the first or second surface.

8. The anti-copy film of claim 1 further comprising a light transmissive adhesive layer disposed on the second surface of the imageable substrate.

9. The anti-copy film of claim 8, wherein the adhesive layer has a refractive index that is substantially the same as the refractive index of the imageable substrate.

10. The anti-copy film of claim 8, wherein the adhesive is selected from the group consisting of permanent pressure sensitive adhesive, repositionable pressure sensitive adhesive, permanent hot melt adhesive, and repositionable hot melt adhesive.

11. The anti-copy film of claim 8 in the form of a tape, a label, or a document laminate, or a pocket.

* * * * *

UNITED STATES PATENT AND TRADEMARK OFFICE

CERTIFICATE OF CORRECTION

PATENT NO. : 7,326,504 B2
APPLICATION NO. : 11/251166
DATED : February 5, 2008
INVENTOR(S) : Paul D. Graham It is certified that error appears in the above-identified patent and that said Letters Patent is hereby corrected as shown below:

Page 2, Column 2
Under "U.S. Patent Documents", delete "Vellgdan et al." and insert --Veligdan et al."--, therefor.

Column 1
Line 6, delete "The present invention" and insert --This application--, therefor.
Line 7, after "11/250,676" insert --,--.
Line 13, delete "a" and insert --an--, therefor.

Column 3
Line 5, delete "an" and insert --a--, therefor.
Line 51, delete "electrographic" and insert --electrophotographic--, therefor.

Column 4
Line 47, delete "Xiekon™" and insert --Xeikon™--, therefor.

Signed and Sealed this

Twelfth Day of August, 2008

JON W. DUDAS
*Director of the United States Patent and Trademark Office*